US005859915A

United States Patent [19]

Norris

[11] Patent Number: 5,859,915

[45] Date of Patent: Jan. 12, 1999

[54] LIGHTED ENHANCED BULLHORN

[75] Inventor: Elwood G. Norris, Poway, Calif.

[73] Assignee: American Technology Corporation

[21] Appl. No.: 846,637

[22] Filed: Apr. 30, 1997

[51] Int. Cl.[6] ..... H04R 27/04

[52] U.S. Cl. ..... 381/75; 381/77; 381/82

[58] Field of Search ..... 381/75, 82, 77; 29/169.5

[56] References Cited

U.S. PATENT DOCUMENTS

| | | | |
|---|---|---|---|
| 1,616,639 | 2/1927 | Sprague . | |
| 1,951,669 | 3/1934 | Ramsey . | |
| 2,461,344 | 2/1949 | Olson . | |
| 3,012,222 | 12/1961 | Hagemann . | |
| 3,398,810 | 8/1968 | Clark, III . | |
| 3,461,421 | 8/1969 | Stover . | |
| 3,612,211 | 10/1971 | Clark, III . | |
| 3,613,069 | 10/1971 | Cary et al. . | |
| 3,710,332 | 1/1973 | Tischner et al. . | |
| 3,723,957 | 3/1973 | Damon . | |
| 3,742,433 | 6/1973 | Kay et al. . | |
| 3,836,951 | 9/1974 | Geren et al. . | |
| 4,207,571 | 6/1980 | Passey . | |
| 4,245,136 | 1/1981 | Krauel, Jr. . | |
| 4,378,596 | 3/1983 | Clark . | |
| 4,593,160 | 6/1986 | Nakamura . | |
| 4,823,908 | 4/1989 | Tanaka et al. . | |
| 4,991,148 | 2/1991 | Gilchrist . | |
| 5,181,301 | 1/1993 | Wheeler | 29/169.5 |
| 5,317,543 | 5/1994 | Grosch . | |
| 5,357,578 | 10/1994 | Taniishi . | |

FOREIGN PATENT DOCUMENTS

| | | | |
|---|---|---|---|
| 2-265400 | 10/1990 | Japan | 381/75 |

OTHER PUBLICATIONS

Ultrasonic Ranging System—Polaroid.

Helmholtz (Excerpts from On Combination Tones)—Editor's Comments on Paper 16.

Aoki, K., et al., "Parametric Loudspeaker—Characteristics of Acoustic Field and Suitable Modulation of Carrier Ultrasound," Electronics and Communications in Japan, Part 3, vol. 74, No. 9, pp. 76–82 (1991).

Makarov, S.N., et al., "Parametric Acoustic Nondirectional Radiator," *Acustica*, vol. 77 (1992).

Westervelt, P.J., "Parametric Acoustic Array," *The Journal of the Acoustical Society of America*, vol. 35, No. 4, pp. – (1963).

*Primary Examiner*—Sinh Tran

*Attorney, Agent, or Firm*—Thorpe, North & Western, LLP

[57] ABSTRACT

A sound projection device for use in speaking to one or more specific persons on a selective basis, the device including a housing having a directional aspect for aiming the housing at a target area, a gripping handle coupled to the housing to enable the device to be held in a user's hand, and a parametric speaker coupled to a front end of the housing for indirectly generating at least one new sonic frequency from at least two ultrasonic frequencies of different value. The housing includes a luminating source having a directional orientation substantially aligned with the directional aspect of the housing. The combination of light and directional sound source enables the user to visually identify the target area before transmitting the sonic frequency to the target.

31 Claims, 4 Drawing Sheets

LIGHTED ENHANCED BULLHORN

BACKGROUND OF THE INVENTION

1. Field of the Invention

This invention pertains to handheld sound projection devices. More particularly, the present invention relates to a device and method for enhancing a bullhorn with directionally projected light in combination with a directional parametric speaker.

2. State of the Art

Outdoor sound projection and amplification is typically accomplished with a megaphone or bullhorn device capable of extending the distance of speech projection. Such focusing devices are necessary because the human voice quickly dissipates in an open environment. This arises in part from the fact that the human speech mechanism is extremely effective in omnidirectional sound projection. The complex resonant structure of the skull, mask of the face and vocal column are amazingly proficient in radiating sound in a generally omnidirection manner.

A megaphone operates to more effectively match the interface between an open environment and the mouth of the speaker. By channeling the sound through an expanding cone, the compression waves that must carry the sound are restricted in path and provided with an enlarging planar wave front diameter. By the time the wave front is enlarged to the opening size of the megaphone, a strong directional element is achieved, enabling a projection area of an enlarging wedge, rather than the conventional omnidirectional propagation pattern.

Despite the increased distance range of the megaphone, an unaided voice is quickly attenuated in proportion to the square of the distance. A bullhorn complements the megaphone structure with electronic voice amplification. By boosting the amplitude of the voice with a conventional amplifier circuit, a significantly extended range of hearing is achieved. Nevertheless, the pattern of propagation is still very divergent once the sound waves clear the horn structure. This results in a general broadcast to the surrounding area, without ability to limit the listening audience. The inconvenience of general dissemination of the amplified voice communication has become accepted as an inherent limitation of a bullhorn or similar sound projection system. For example, a police helicopter equipped with a PA system can broadcast emergency messages; however, they are broadcast generally rather than being directable to a specific target area. At night, such messages may alarm or even awaken persons who need not be involved. Other messages generally broadcast can create confusion where people listen who have no interest or knowledge of the matter communicated.

A more recent technology involving directional sound has developed as part of an attempt to reproduce sound without use of a moving diaphragm such as is applied in a conventional bullhorn. This second sound propagation approach includes technologies embodied in parametric speakers, acoustic heterodyning, beat frequency interference and other forms of modulation of multiple frequencies to generate a new frequency.

In theory, sound is developed by the interaction in air (as a nonlinear medium) of two ultrasonic frequencies whose difference in value falls within the audio range. Ideally, resulting compression waves would be projected within the air as a nonlinear medium, and would be heard as pure sound. An interesting property of parametric sound generation is enhanced directionality. Despite significant publications on ideal theory, however, general production of sound for practical applications has alluded the industry for over 100 years. Specifically, a basic parametric or heterodyne speaker has not been developed which can be applied in general applications in a manner such as conventional speaker systems.

A brief history of development of the theoretical parametric speaker array is provided in "Parametric Loudspeaker—Characteristics of Acoustic Field and Suitable Modulation of Carrier Ultrasound", Aoki, Kamadura and Kumamoto, *Electronics and Communications in Japan*, Part 3, Vol. 74, No.9 (March 1991). Although technical components and the theory of sound generation from a difference signal between two interferring ultrasonic frequencies is described, the practical realization of a commercial sound system was apparently unsuccessful. Note that this weakness in the prior art remains despite the assembly of a parametric speaker array consisting of as many as 1410 piezoelectric transducers yielding a speaker diameter of 42 cm. Virtually all prior research in the field of parametric sound has been based on the use of conventional ultrasonic transducers, typically of bimorph character.

U.S. Pat. No. 5,357,578 issued to Taniishi in October of 1994 introduced alternative solutions to the dilemma of developing a workable parametric speaker system. Hereagain, the proposed device comprises a transducer which radiates the dual ultrasonic frequencies to generate the desired audio difference signal. However, this time the dual-frequency, ultrasonic signal is propagated from a gel medium on the face of the transducer. This medium 20 "serves as a virtual acoustic source that produces the difference tone 23 whose frequency corresponds to the difference between frequencies $f_1$ and $f_2$." Col 4, lines 54–60. In other words, this 1994 reference abandons direct generation of the difference audio signal in air from the face of the transducer, and depends upon the nonlinearity of a gel medium to produce sound. This abrupt shift from transducer/air interface to proposed use of a gel medium reinforces the perception of apparent inoperativeness of prior art disclosures, at least for practical speaker applications.

Therefore, although the parametric speaker has created interest, it has seemingly been restricted to scientific curiousity. The development of practical applications and products has been very limited. The efficiency of such systems has apparently not been adequate to suggest its utility in applications in combination with a megaphone or bullhorn.

OBJECTS AND SUMMARY OF THE INVENTION

It is an object of the present invention to provide a method and apparatus for indirectly emitting new sonic and subsonic waves as part of a handheld amplification system with greatly enhanced directional properties.

It is another object to adapt parametric sound using interference between at least two ultrasonic signals having different frequencies to develop a narrow beam of a new sonic or subsonic wave which can be focused on a single individual as part of a group of persons.

It is still another object to provide a bullhorn type device which develops a substantially uniform wave front across a broad ultrasonic emitter surface which has a narrow pattern of divergence.

A still further object of this invention is to provide a parametric bullhorn device which includes a directional light source in common directional alignment with a projected sound beam.

It is an object of the present inveniton to provide a bullhorn device with highly directional sound and a target identification means for confirming accurate engagement with a selected listener.

Another object of the present invention is to enable target identification with a projected light from the bullhorn to visually confirm when the selected listener has been accurately engaged.

These and other objects are realized in a voice projecting device which comprises a housing having a configuration which supplies a directional orientation such as with a horn incorporating a parametric speaker array. The parametric speaker generates at least one new sonic frequency from at least two ultrasonic frequencies of different value, and projects them directionally toward the targeted area. The speaker comprises i) an ultrasonic frequency generator; ii) a sonic frequency generator; iii) modulating means coupled to the ultrasonic frequency generator and the sonic frequency generator for producing the at least two ultrasonic frequencies of different value; and iv) at least one ultrasonic frequency emitter coupled to the modulating means and aligned for transmission with the directional orientation of the housing for propagating the at least two ultrasonic frequencies and concurrently generating the new sonic frequency with directional sound transmission orientation toward the target. An actuating mechanism is coupled to the housing for activating the parametric speaker means to generate the new sonic frequency. A light source may also be attached to the housing for providing visual targeting where the parametric speaker and light source are in common target alignment.

Other objects, features and benefits will be apparent to those skilled in the art, based on the following detailed description, in combination with the accompanying drawings.

DETAILED DESCRIPTION OF THE PREFERRED EMBODIMENT

Figure 1:
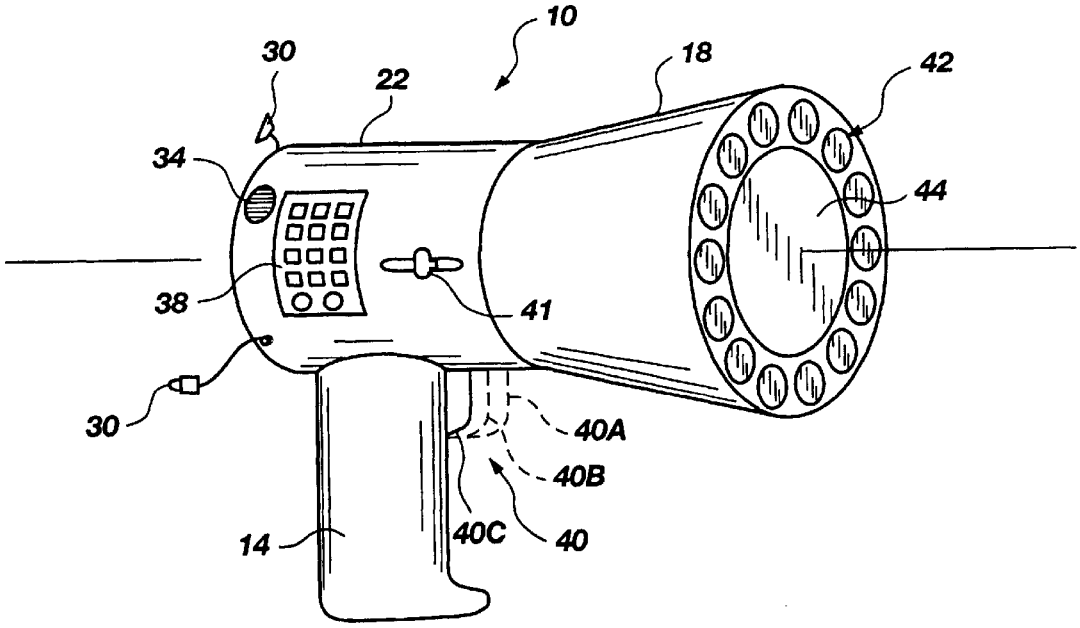
FIG. 1 illustrates one embodiment of a voice projecting device.

FIG. 1 illustrates one embodiment of a voice projection system similar to a bullhorn. It will be apparent that this specific structure is intended to represent many different types of projection devices such as PA systems, megaphones, etc., particularly where a directional orientation in a narrow beam is desired.

The preferred embodiment comprises a bullhorn 10 which includes a handle 14, horn 18 and primary body 22. The handle 14 can be any structure which enables the user to support the bullhorn 10 in a directional position. The primary body 22 also operates as a housing for containment of the operating mechanisms, circuitry and battery power. In addition, the bullhorn 10 may include a user speaker 30, a microphone 34, a control pad 38, a trigger 40, a focal length adjustor 41, and a parametric speaker array 42 for directionally transmitting the sound.

In the preferred embodiment, the user speaker 30 takes the form of either an ear jack, ultrasonic transducer or a simple audio speaker. The purpose of the speaker is to allow the user of the bullhorn 10 to hear the sounds that the bullhorn sends to a selected target 43 (see FIG. 2). Otherwise, the transmitted sound is so directional in an outdoor environment that it would essentially be undetected by the user. The microphone 34 is actuated by audio signals from the user in proximity of the bullhorn 10.

Figure 2:
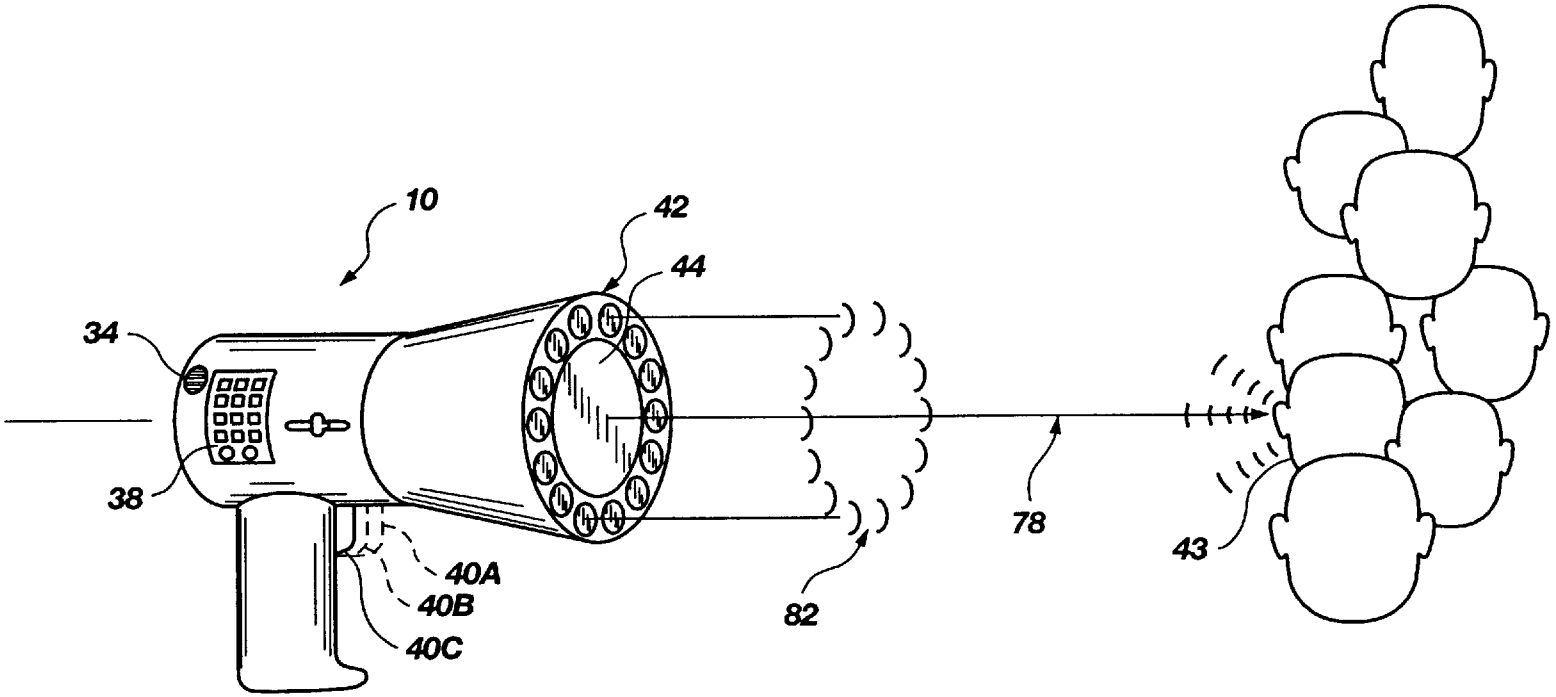
FIG. 2 depicts the subject device in operation toward a selected person as part of a crowd.

Although, as shown in FIG. 2, the user may desire to send personal voice messages to the target 43, the user may also desire to remain anonymous and otherwise undetectable by sending distorted voice messages. The control panel 38 allows the user to select distortion mode and pre-recorded messages, as well as other modes of operation for the bullhorn 10. For example, the control panel 38 could be used to disable the microphone 34 or to select different bullhorn operations, e.g., a sound-only system, a light-only mode, a combined light and sound transmission, sound output with modulated light output, active sound with microphone, sound with pre-recorded messages, or any other combination which implements principles of the present invention.

The trigger 40 is shown in both solid and hidden lines to indicate that the trigger has multiple positions, i.e., a rest position 40A, an intermediate position 40B, and an engaged position 40C. In the preferred embodiment, the rest position 40A is used when the bullhorn 10 is not in use. The intermediate position 40B partially engages the bullhorn 10 by engaging a light source 44 but not the parametric speaker 42. This light source 44 is controlled by the focal length adjustor 41 so that a beam of light may be directed to the target 43. If the control panel 38 is so programmed, the engaged position 40C of the trigger 40 is used to engage the light source 44 in combination with the parametric speaker 42.

The use of a directional light beam 78 in combination with directional sound 82 creates many benefits previously unknown within the voice projection industry. For example, a focused beam of light provides a silent scanning device for target identification. The user simply activates the light source 44 and moves the bullhorn 10 until the desired recipient (or target 43) is illuminated with a spot of light. This silent mode of target detection provides an advantage to the user because it allows for the element of surprise. The user knows he has accurate recipient identification because the light 78 and sound beams 82 are in substantial alignment. Therefore, the user is able to confirm that the identified individual is probably receiving the audio transmission from the bullhorn.

Many forms of light source 44 are well suited for this duality aspect of sound and light. For example, the directional light source 44 may be a laser, a light emitting diode, a flash tube with parabolic reflector, or any other form of directional light source which can provide a narrow light beam 78. Where full illumination of the individual or group intended to receive the message, a spotlight having intense illumination may be used. The adjustible focusing device (or focal length adjustor 41) may also be added to provide depth adjustment for the focal point of the beam.

The primary component of the present invention is the parametric speaker 42 which is coupled to an emitter end of the housing 26 for indirectly generating at least one new sonic frequency from at least two ultrasonic frequencies of different value. The principles and structure enabling generation of this parametric or acoustical heterodyne effect have been set forth in previous applications of the present inventor, including Ser. No. 08/744,114. In addition, the general theory of difference wave generation between two ultrasonic frequencies has been well documented within the prior art. The present inventor has advanced the theory to a level of commercial application with significant improvements which have increased amplitude output and focused directionality.

Figure 3:
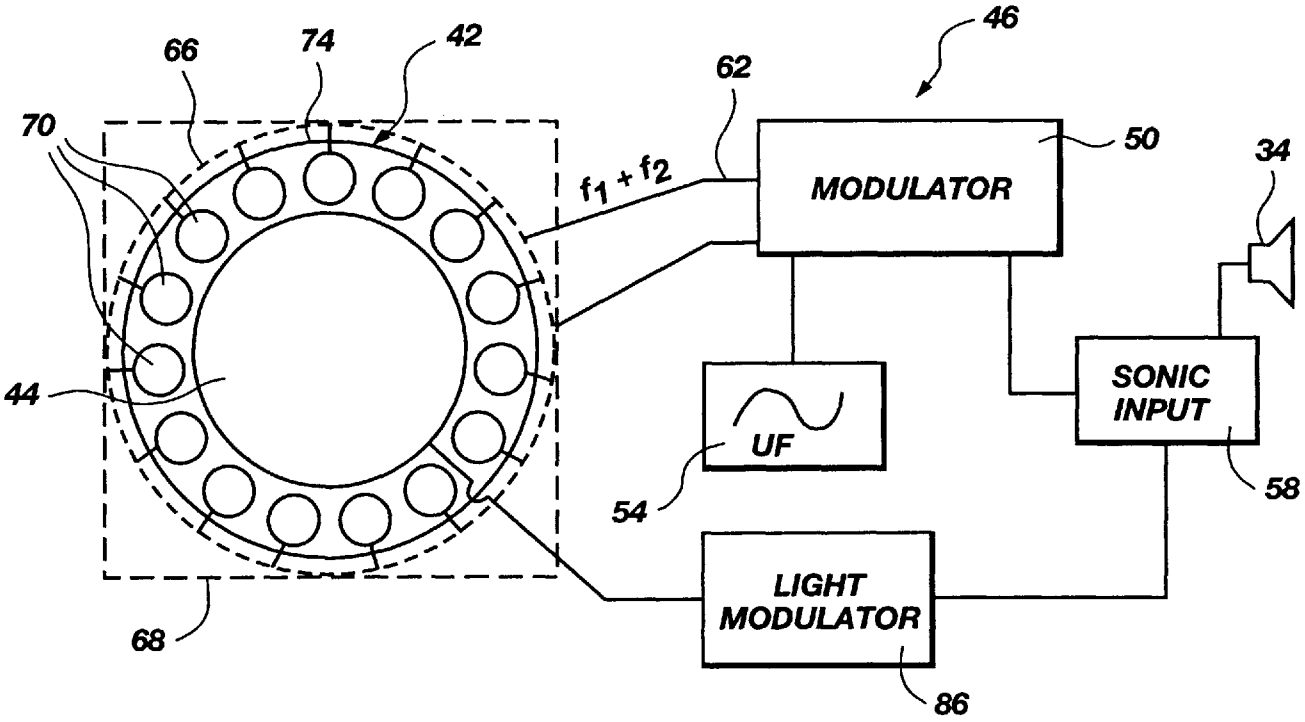
FIG. 3 illustrates supporting circuitry and power source shown coupled in block diagram.

As illustrated in FIG. 3, the parametric speaker 42 includes a typical circuit 46 in which a modulator 50 is coupled to an ultrasonic frequency generator 54 and a sonic frequency generator 58. Amplitude modulation operates to produce at least two ultrasonic frequencies 62 of different value, such that the modulated output embodies a new sonic signal which is decoupled when emitted within a nonlinear medium such as air. In this case, using either an upper or lower sideband, a new sonic signal is generated in the air, equal to 5 kHz, based on the difference of the base carrier frequency of 50 kHz and 45 khz or 55 kHz sideband signals. This new sonic output is extremely directional in view of the high frequency of the carrier in the ultrasonic range. This enables the user to aim the bullhorn 10 at a distant target 43, engage the parametric speaker 42 and emit the 5 kHz sonic compression wave at the target.

In basic form, the parametric speaker 42 comprises an ultrasonic frequency generator 54 for providing a base or carrier frequency which is identified as $f_1$. This frequency is typically in a range of 40 kHz to 100 kHz, well above the audio range of 20 to 20,000 Hz. Therefore, the base frequency is not detectable to the human user.

Essentially, the ultrasonic base frequency develops audio output by combining in air with a second ultrasonic frequency whose value differs from the base frequency by a frequency range within audio bandwidth. This is accomplished by use of a sonic frequency generator 58 programmed to supply the desired sonic signal. This may be a preprogrammed computer chip which includes various messages or direct voice amplification useful in voice projection. Direct voice amplification responds to sonic signals that are generated at the bullhorn and detected by the microphone 34. For example, the user could speak into the microphone 34 and have the audio signals entered into the sonic frequency generator 58.

In each instance, the sonic output is fed to the modulator 50 which modulates the sonic signal with the ultrasonic base frequency to produce at least two frequencies, $f_1$ and $f_2$, representing two ultrasonic frequencies. For example, if $f_1$ equals 50 kHz and the sonic signal is 5 kHz, the resulting frequencies include the base frequency 50 kHz and sideband ultrasonic frequencies 45 kHz and 55 kHz, comprising the sum of the modulated frequencies.

FIGS. 3 also identifies an ultrasonic emitter component 66 of the parametric speaker 42. This component 66 comprises at least one ultrasonic frequency emitter 70 coupled to the modulator 50 and aligned for transmission with the directional orientation of the housing 26. The emitter 70 may be any transducer or other means for generating ultrasonic frequencies in accordance with parametric technology. The specific transducers 70 (or emitters) shown in this embodiment comprise a set of bimorph transducers which form a perimeter around the outside of the horn emitter end 74. The perimeter of FIG. 3 is configured in a circular shape, but may be in other ring shapes such as a rectangular shape 68. Any ultrasonic emitter may be used which meets the space limitations inherent in the bullhorn configuration. The actual number of transducers 70 will depend on the physical dimensions of the horn 18 or emitter 70 structure.

In the present embodiment, the transducers 70 are positioned around emitter end 74 of the bullhorn 10 to form a parametric array. It has been discovered that a ring of transducers 70 is surprisingly effective in generating a highly directional, high amplitude, narrow beam of sonic output. Indeed, the absence of transducers within the ring appears to have little effect on the actual output of the parametric array. The sound pressure level (SPL) attenuation as a function of distance is virtually the same for a ring of transducers, as for a continuous array of transducers disposed across the full surface of the horn 18 end. This discovery enables successful implementation of the present invention because the ring of transducers 70 is ideal for a circumferential configuration around a barrel or other bullhorn body. It also enables adaptation of the bullhorn with other features such as the fixation of the light source 44 within the horn opening.

A further entertaining feature of the dual sound and light aspect of the present invention occurs when the light source 44 includes a light modulator 86 for modulating transmission of the light source 44 with sonic input from the parametric speaker 42. A conventional modulation circuit coupled between the parametric speaker 42 and the voltage source for the light enables the light intensity to vary with variations in the sonic output. For example, light intensity may track amplitude of the sonic output, and thereby provide a visual component to the broadcast speech of the bullhorn.

This combination of sound and light transmission provides a surprising feature of being able to "throw" or project the users voice from a distant object. For example, a policeman in pursuit of a suspect may give a warning message to surrender to custody. By directing the light at a distant wall, a proper reflective surface can be identified. The voice message can then be activated, giving the suspect a false sense of police location from the reflected surface. The suspect is then misoriented as to the direction of pursuit of the police. Because the suspect will likely move away from the source of the voice, the police can often predict the direction of flight and can position other officers in that path.

This same feature is useful in entertainment. A ventriloquist may speak into a lapel microphone which is activated by his foot during a dialog. This "dummy" voice would be projected onto a distant face representing his partner. By alternately activating the bullhorn or voice projection device with the foot pedal, the single ventriloquist can create actual voice separation between two locations. For interesting effect, the light may be projected with the voice. By modulating the light with voice output as is discussed hereafter, an interesting "talking light" phenomenon is achieved.

As indicated above, the device may include an integrated computer chip having prerecorded sonic messages which supply instruction, warning or other content which is of a recurring need. This chip is responsive to the control pad 38 (or selector) for preselecting one of the prerecorded messages for transmission from the parametric speaker 42. The prerecorded message is useful for many applications such as protecting the identify of the user by masking his voice, or simply substituting another voice from a different individual. Use of the prerecorded message also avoids a need for the user to personally give the message and thereby compromise his location. With the prerecorded message, the user need say nothing. The parametric array projects the recorded voice in a directional manner, enabling the user to target a select place or individual for private transmission of the message. The absence of sound other than along the narrow beam of parametric sound, prevents others from hearing what is projected.

This selective control of the sound and light circuits are collectively manipulated by the trigger 40 which is coupled to the housing 26. In this embodiment, the three-position trigger enables the use of the rest position 40A for when the bullhorn 10 is not in use, the activation of the light source 44 at the intermediate position 40B, and the engaged position 40C available for subsequently activating the parametric speaker 42. This sequence facilitates visual identification of the target based on a spot of light with the intermediate trigger position 40B. The engaged trigger position 40C can then be selected, giving the sonic signal which conveys the desired message.

Figure 4:
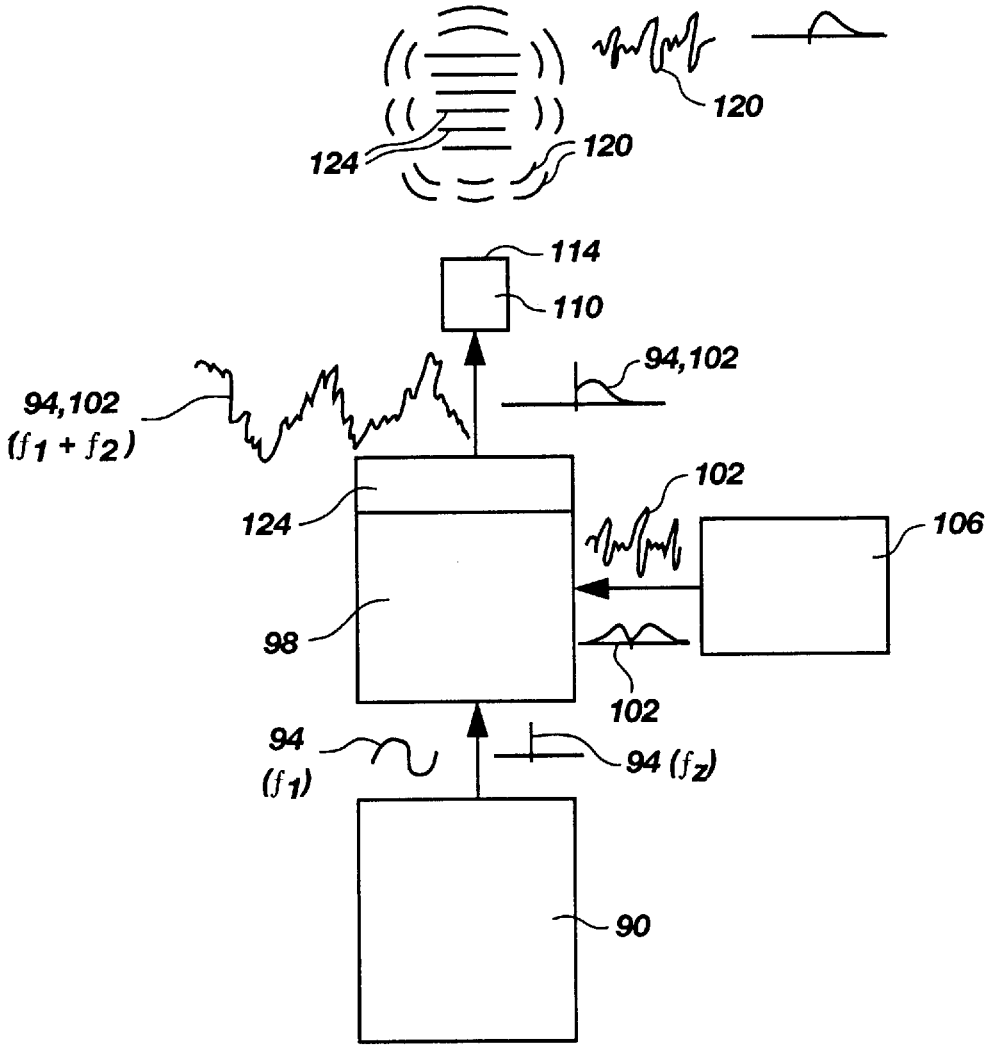
FIG. 4 shows an alternate embodiment of the present invention.

FIG. 4 illustrates a basic system which includes an oscillator or digital ultrasonic wave source 90 for providing a base or carrier wave 94. This wave 94 is generally referred to as a first ultrasonic wave or primary wave. An amplitude modulating component 98 is coupled to the output of the ultrasonic wave source (or generator) 90 and receives the base frequency or carrier wave 94 for mixing with a sonic or subsonic input signal 102. The sonic or subsonic signal 102 may be supplied in either analog or digital form, and could be sound from any conventional signal source 106. If the input signal 102 includes upper and lower sidebands, a filter component may be included in the modulator to yield a single sideband output on the modulated carrier frequency for selected bandwidths.

The emitter drum transducer is shown as item 110, which is caused to emit the ultrasonic frequencies $f_1$ and $f_2$ as a new wave form propagated at the face of a thin film transducer 114. This new wave form interacts within the nonlinear medium of air to generate the difference frequency 120, as a new sonic or subsonic wave. The ability to have large quantities of emitter elements formed in an emitter disk is particularly well suited for generation of a uniform wave front which can propagate quality audio output and meaningful volumes.

The present invention is able to function as described because the compression waves corresponding to $f_1$ and $f_2$ interfere in air according to the principles of acoustical heterodyning. Acoustical heterodyning is somewhat of a mechanical counterpart to the electrical heterodyning effect which takes place in a non-linear circuit. For example, amplitude modulation in an electrical circuit is a heterodyning process. The heterodyne process itself is simply the creation of two new waves. The new waves are the sum and the difference of two fundamental waves.

In acoustical heterodyning, the new waves equaling the sum and difference of the fundamental waves are observed to occur when at least two ultrasonic compression waves interact or interfere in air. The preferred transmission medium of the present invention is air because it is a highly compressible medium that responds nonlinearly under different conditions. This nonlinearity of air enables the heterodyning process to take place, decoupling the difference signal from the ultrasonic output. However, it should be remembered that any compressible fluid can function as the transmission medium if desired.

Whereas successful generation of a parametric difference wave in the prior art appears to have had only nominal volume, the present configuration generates full sound. While a single transducer carrying the AM modulated base frequency was able to project sound at considerable distances and impressive volume levels, the combination of a plurality of co-linear signals significantly increased the volume. When directed at a wall or other reflective surface, the volume was so substantial and directional that it reflected as if the wall were the very source of the sound generation.

An important feature of the present invention is that the base frequency and single or double sidebands are propagated from the same transducer face. Therefore the component waves are perfectly collimated. Furthermore, phase alignment is at maximum, providing the highest level of interference possible between two different ultrasonic frequencies. With maximum interference insured between these waves, one achieves the greatest energy transfer to the air molecules, which effectively become the "speaker" radiating element in a parametric speaker. Accordingly, the inventor believes the enhancement of these factors within a thin film, ultrasonic emitter array as provided in the present invention have developed a surprising increase in volume to the audio output signal.

These various structural components enable practice of a novel method for supplying directional sound from a parametric array within a bullhorn or pointer by indirectly generating at least one new sonic frequency which is a difference of at least two interacting ultrasonic frequencies. The basic method comprises the steps of a) emitting from the bullhorn at least one first ultrasonic frequency along a direction which is in alignment with a directional orientation of the bullhorn; b) emitting from the bullhorn a second ultrasonic frequency in a manner which causes the second ultrasonic frequency to interact with the first ultrasonic frequency to generate the new sonic frequency, wherein the second ultrasonic frequency has a frequency equal to the at least one first ultrasonic frequency plus at least one sideband corresponding to the at least one new sonic frequency; and c) directing the bullhorn at a target and operating the bullhorn to propagate toward the target the at least one new sonic frequency.

It is to be understood that the above-described embodiments are only illustrative of the application of the principles of the present invention. Numerous modifications and alternative arrangements may be devised by those skilled in the art without departing from the spirit and scope of the present invention. The appended claims are intended to cover such modifications and arrangements.

What is claimed is:

1. A method for supplying directional sound and light from a voice projection device by indirectly generating at least one new sonic frequency which is a difference of at least two interacting ultrasonic frequencies, the method comprising the steps of:

a) emitting from a perimeter of the projection device at least one first ultrasonic frequency along a direction which is in alignment with a directional orientation of the projection device;

b) emitting from the projection device a second ultrasonic frequency by means which cause the second ultrasonic frequency to interact with the first ultrasonic frequency to generate the new sonic frequency, wherein the second ultrasonic frequency has a frequency equal to the at least one first ultrasonic frequency plus at least one sideband corresponding to the at least one new sonic frequency;

c) directing a light from within the perimeter of the projection device along the directional orientation toward a common target area with the new sonic frequency; and d) propagating a desired message as the new sonic frequency.

2. A method as defined in claim 1, further comprising the step of generating the at least one new sonic frequency as a sonic output corresponding to a human voice message.

3. The method as defined in claim 1, further comprising the step of electronically amplifying speech of a user of the device and modulating the speech as part of the second ultrasonic frequency to thereby transmit the speech to the target in a directionally isolated manner.

4. The method as defined in claim 1, further comprising the step of recording the at least one new sonic frequency on a memory chip and transmitting the at least one new sonic frequency from the memory chip as part of the second ultrasonic frequency.

5. The method as defined in claim 1, further comprising the step of emitting a directional light from the device along the directional orientation to identify the common target area visually, thereby enabling isolation of the common target for transmitting the at least one new sonic frequency.

6. The method as defined in claim 5, further comprising the step of modulating the light emitted from the device with the at least one new sonic frequency.

7. The method defined in claim 5, comprising the additional step of modulating the light emitted from the device with sonic input, thereby creating a variable light transmission which correlates with the sonic input.

8. The method as defined in claim 1, further comprising the step of transmitting a predetermined voice message to a designated target in an isolated manner so that the message is heard only in direct proximity to the common target area.

9. A speech projection device having a directional orientation for emitting both light and sound from a user in a narrow beam with selective focus toward another person at a distance by indirectly propagating from the user at least one new sonic frequency as a by-product of emitting at least two ultrasonic frequencies from an ultrasonic frequency emitter, said device comprised of:

a housing having a light transmitting opening and an audio emitting perimeter positioned at an emitting end of the housing, said light transmitting opening and the audio emitting perimeter having a generally common directional orientation along a common transmission axis;

an ultrasonic frequency signal source contained within the housing for providing a first ultrasonic frequency signal;

a sonic frequency generator coupled to the housing for supplying an electrical signal corresponding to the at least one new sonic frequency;

modulating means contained within the housing and coupled to the ultrasonic frequency signal generator and sonic frequency generator for combining the first ultrasonic frequency signal with the electrical signal corresponding to the at least one new sonic frequency to thereby generate a second ultrasonic frequency signal;

a plurality of ultrasonic frequency emitters positioned at the audio emitting perimeter of the housing which are coupled to an output of the modulating means for (i) propagating both the first and second ultrasonic frequency signals, and (ii) generating the at least one new sonic frequency wave train as a by-product of interference between the first and second ultrasonic frequency signals; and a directional light source positioned at the light transmitting opening and having a directional means for focusing light toward another person.

10. A device as defined in claim 9, wherein the audio emitting perimeter is configured in a circular shape, said ultrasonic frequency emitters being disposed in a circular pattern within the perimeter.

11. A device as defined in claim 9, wherein the audio emitting perimeter is configured in a rectangular shape, said ultrasonic frequency emitters being disposed in a linear, rectangular pattern within the perimeter.

12. A device as defined in claim 9, wherein the audio emitting perimeter is configured in a rectangular shape, said ultrasonic frequency emitters being disposed in a rectangular pattern within two opposing sides of the rectangular shape.

13. A device as defined in claim 9, wherein the sonic frequency generator comprises a microphone positioned at an opposing end of the housing from the emitting perimeter to be responsive to audio input from the user.

14. The device as defined in claim 9 wherein the modulating means comprises an amplitude modulating device which modulates an ultrasonic frequency signal with a sonic signal to thereby generate the at least two ultrasonic frequencies, said modulating means including means for generating the at least one new sonic frequency to be transmitted to the target area.

15. The device as defined in claim 14 wherein the modulating means includes means for generating a single sideband signal embodying the at least two ultrasonic frequencies for optimizing amplitude and transmission of a sonic frequency of predetermined bandwidth.

16. The device as defined in claim 9, wherein the sonic frequency generator includes an integrated computer chip having prerecorded sonic signals comprising prerecorded messages.

17. The device as defined in claim 16, further comprising means for supplying a plurality of different prerecorded sonic signals, and including selector means for preselecting one of the prerecorded signals for transmission from the ultrasonic frequency emitters.

18. The device as defined in claim 16, wherein the prerecorded messages are selected from the group of human voice messages consisting of a police warning to a suspect, a fireman message to a person in jeopardy, a military message to a combatant, a security guard message to a possible intruder, a confidential message to a selected individual within a group of people, a prompting message to a performer, and a technician message to a member of a stage crew.

19. The device as defined in claim 9, further comprising means for recording additional sounds to a signal storage means coupled to the sonic frequency generator.

20. The device as defined in claim 9, wherein the directional light source comprises a laser.

21. The device as defined in claim 9, wherein the directional light source comprises a light emitting diode.

22. The device as defined in claim 9, wherein the directional light source comprises a flash tube.

23. The device as defined in claim 9, further comprising light modulating means for modulating transmission of the directional light source with sonic input from the ultrasonic frequency emiters.

24. The device as defined in claim 23, wherein the light modulating means responds to different frequency values of the sonic input to create correlated light and sound concurrently emitted from the speech projection device.

25. The device as defined in claim 23, wherein the light modulating means includes means for correlating the sonic input the sonic input comprising speech with output of the directional light source, thereby creating an impression of a talking light.

26. The device as defined in claim 25, further comprising microphone means coupled to the sonic frequency generator for enabling direct transmission of a sonic frequency comprising a human voice to the another person.

27. The device as defined in claim 9, further comprising focusing means operable with respect to the directional light source for increasing light intensity at a desired distance and location.

28. The device as defined in claim 9 wherein the housing comprises a configuration selected from the group consisting of a bullhorn, a flashlight, and a megaphone.

29. The device as defined in claim 9 wherein the plurality of the ultrasonic frequency emitter are comprised of an ultrasonic acoustical transducers.

30. The device as defined in claim 9, further comprising a microphone and associated audio amplification circuitry coupled to the housing for detecting sound, said audio amplification circuitry being coupled to the modulating means for providing the detected sound as a new sonic frequency to enable transmission of speech as the new sonic frequency.

31. The device as defined in claim 9 wherein the device further comprises an ultrasonic frequency signal generator which transmits the first ultrasonic frequency to the modulating means and wherein the modulating means includes input means for mixing at least one new sonic frequency with the first ultrasonic frequency as upper and lower sidebands for transmitting low frequencies within an audio range.

* * * * *